US008577229B2

(12) United States Patent
Holden et al.

(10) Patent No.: US 8,577,229 B2
(45) Date of Patent: Nov. 5, 2013

(54) IMAGE FORMING APPARATUS AND METHOD THEREOF

(75) Inventors: Anthony Holden, Boise, ID (US); Daniel Beltzer, Garden City, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 168 days.

(21) Appl. No.: 13/382,175

(22) PCT Filed: Jul. 27, 2009

(86) PCT No.: PCT/US2009/051807

§ 371 (c)(1), (2), (4) Date: Jan. 4, 2012

(87) PCT Pub. No.: WO2011/014151

PCT Pub. Date: Feb. 3, 2011

(65) Prior Publication Data

US 2012/0189331 A1 Jul. 26, 2012

(51) Int. Cl.
*G03G 15/00* (2006.01)

(52) U.S. Cl.
USPC ..... 399/13; 399/71

(58) Field of Classification Search
USPC ..... 347/5; 399/13, 111
See application file for complete search history.

(56) References Cited

U.S. PATENT DOCUMENTS

| | | | | |
|---|---|---|---|---|
| 5,220,386 | A * | 6/1993 | Aoki et al. | 399/71 |
| 5,572,293 | A | 11/1996 | Kikuchi et al. | |
| 6,203,954 | B1 | 3/2001 | Anayama | |
| 6,991,308 | B2 * | 1/2006 | Yamazaki | 347/5 |
| 2002/0127036 | A1 | 9/2002 | Sato et al. | |
| 2007/0019984 | A1 | 1/2007 | Inagaki et al. | |

OTHER PUBLICATIONS

International Search Report and Written Opinion received in PCT Application No. PCT/US2009/051807, mailed Mar. 24, 2010, pp. 11.

* cited by examiner

*Primary Examiner* — Hoang Ngo

(57) ABSTRACT

An initialization method of an electrophotographic image forming apparatus includes rotating a photosensitive member to receive toner along a width of the photosensitive member prior to activation of a charging unit and to remove the toner with a cleaning unit, and activating the charging unit configured to charge the photosensitive member in response to a determination of a completion of a predetermined number of rotations of the photosensitive member.

15 Claims, 5 Drawing Sheets

IMAGE FORMING APPARATUS AND METHOD THEREOF

BACKGROUND

Electrophotographic image forming apparatuses generally include charging devices, exposure devices, development devices and image transfer devices and are in the form of copiers, laser printers, facsimile devices and multifunctional devices including a print function. Such image forming apparatuses form a latent image corresponding to image data on a photosensitive member. Toner is applied to the latent image and the toner image is transferred to a recording medium in which the toner image is fixed thereon. Generally, a portion of the toner on the photoconductor is not transferred to the recording medium and is removed from the photosensitive member by a cleaning blade.

BRIEF DESCRIPTION OF THE DRAWINGS

Exemplary non-limiting embodiments of the general inventive concept are described in the following description, read with reference to the figures attached hereto and do not limit the scope of the claims. Dimensions of components and features illustrated in the figures are chosen primarily for convenience and clarity of presentation and are not necessarily to scale. Referring to the attached figures;

DETAILED DESCRIPTION

Image forming apparatuses such as electrophotographic image forming apparatuses form a latent image corresponding to image data on a photosensitive member such as an organic photoconductive drum (OPC) by an optical scanning unit such as a laser irradiating the photosensitive member. Toner is applied to the latent image on the photosensitive member to form a toner image which is transferred to a substrate such as paper, or the like. Generally, toner remaining on the OPC after the toner image is transferred from the OPC is removed therefrom by a cleaning blade. However, the charging unit charging the exposed OPC may cause oxidation thereon which increases the friction between the cleaning blade and the OPC potentially causing malfunctioning and/or damage to the cleaning blade and premature degradation of the OPC. For example, the OPC may contain materials susceptible to oxidation such as poly dimethyl siloxane (PDMS) from the manufacturing process or applied thereafter. The cleaning blade and the OPC are particularly susceptible to damage upon the installation of a new print cartridge. The present general inventive concept described below prevents the increased friction and the premature degradation due to the oxidation of the OPC.

Figure 1:
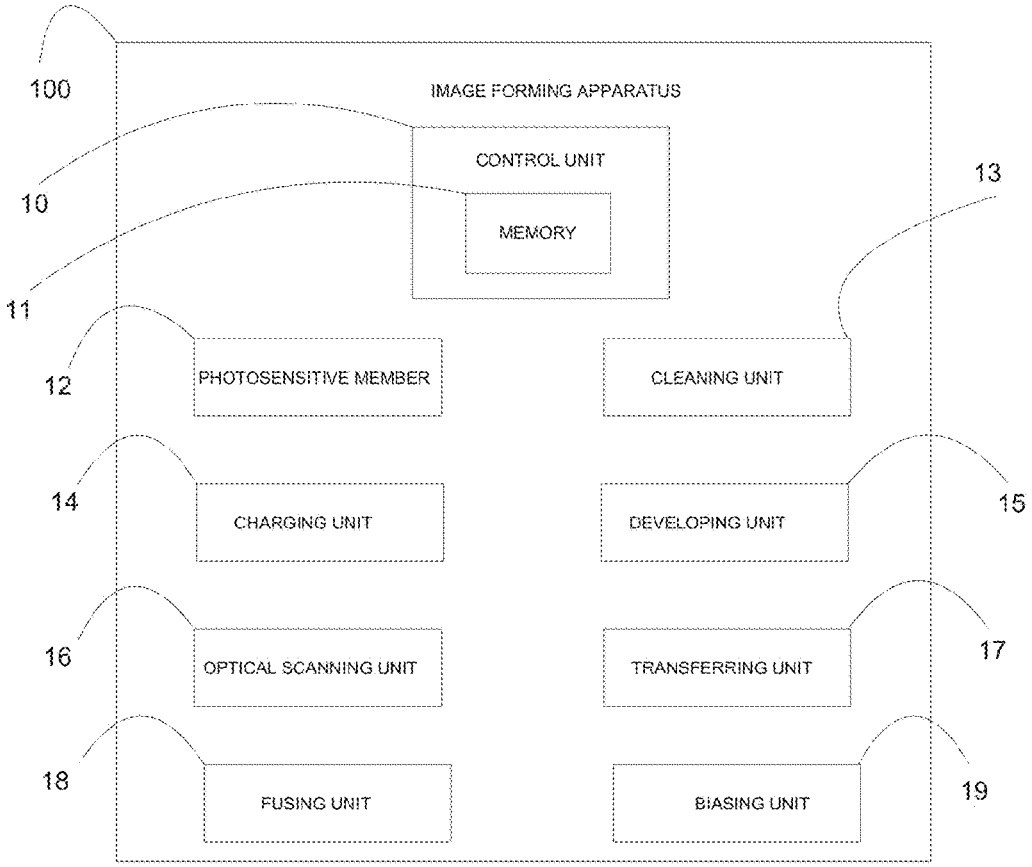
FIG. 1 is a block diagram of an image forming apparatus according to an embodiment of the present general inventive concept.
Figure 2:
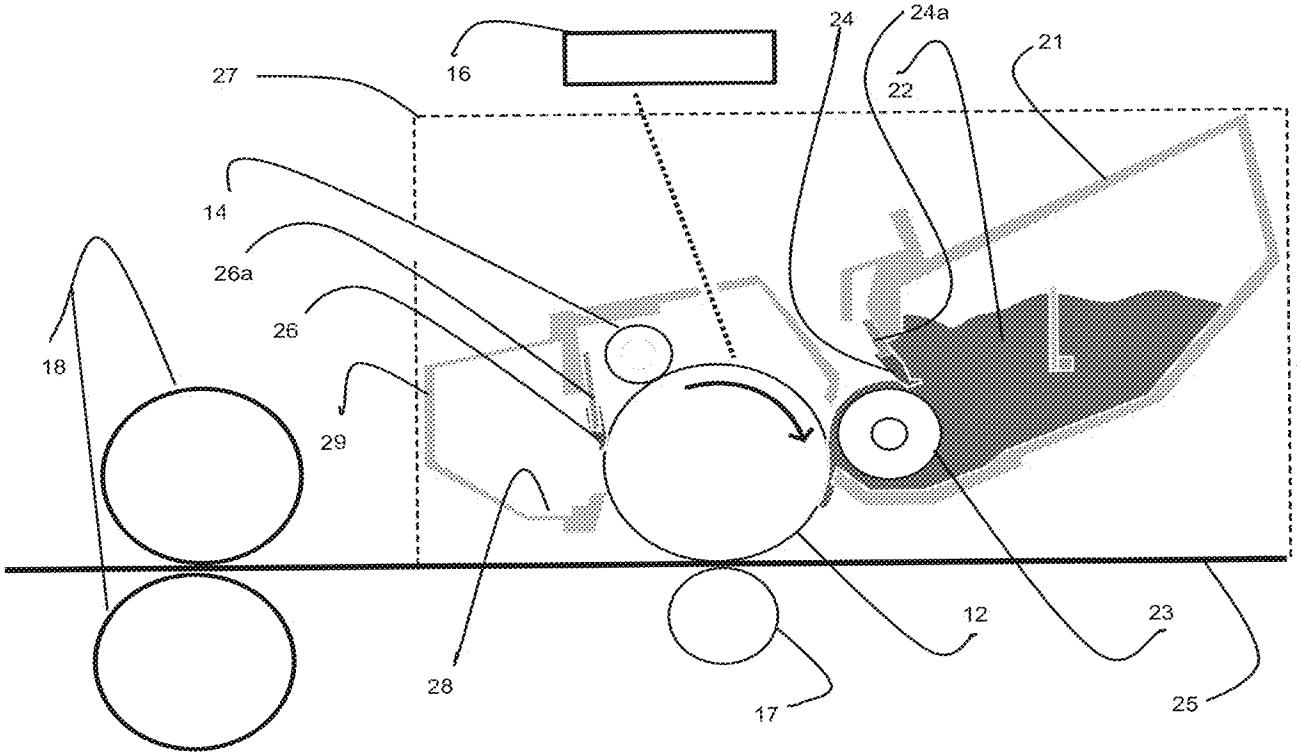
FIG. 2 is a partial sectional view of an image forming apparatus according to an embodiment of the present general inventive concept.

FIG. 1 is a block diagram of an image forming apparatus according to an embodiment of the present general inventive concept. FIG. 2 is a sectional view of an image forming apparatus according to an embodiment of the present general inventive concept. In the present embodiment, the image forming apparatus 100 is an electrophotographic imaging forming apparatus such as a laser printer. Referring to FIGS. 1 and 2, in the present embodiment, the image forming apparatus 100 includes a photosensitive member 12, a charging unit 14, an optical scanning unit 16, a developing unit 15, a biasing unit 19, a transferring unit 17, a fusing unit 18, a cleaning unit 13, and a control unit 10 having a memory 11. In one embodiment, each of the charging unit 14, the optical scanning unit 16, the developing unit 15, the transferring unit 17, and the cleaning unit 13 are disposed across from the photosensitive member 12. The fusing unit 18 may be downstream from the transferring unit 17 in a substrate transporting direction.

Referring to FIGS. 1 and 2, the photosensitive member 12 rotates and is configured to receive a latent image and toner 22. In the present embodiment, the photosensitive member 12 is an organic photoconductive drum (OPC) and rotates, for example, at a constant speed in a clockwise direction as illustrated in FIG. 2. The charging unit 14 is configured to charge the photosensitive member 12, for example, in a uniform manner. The charging unit 14 may be a charging roller in contact with the photosensitive member 12, a corona charger not in contact with the photosensitive member 12 or any other conventional charging unit. The image forming apparatus 100 also includes an optical scanning unit 16 to scan a charged surface of the photosensitive member 12 to form a latent image thereon corresponding to image data. For example, a control unit 10 may be configured to receive image data from a computer or media source, and to control the optical scanning unit 16 to form the latent image corresponding to the image data on the photosensitive member 12. In one embodiment, the optical scanning unit 16 is a laser.

As illustrated in FIGS. 1 and 2, the developing unit 15 is configured to apply the toner 22 on the photosensitive member 12. In one embodiment, the developing unit 15 develops the latent image with the toner 22 on the photosensitive member 12 by reverse development forming a toner image. The developing unit 15 may include a developer housing 21, toner 22 stored in the development housing 21, a developer roller 23 configured to apply the toner 22 to the photosensitive member 12, and a regulating member 24 attached to the developer housing 21 directly or through a regulator support member **24*a* configured to regulate an amount of the toner 22 to be provided to the developer roller 23**.

In the present embodiment, the image forming apparatus 100 includes a biasing unit 19 configured to establish an electrostatic potential difference to allow the toner 22 to be applied to the photosensitive member 12 from the developing unit 15. In one embodiment, for example, the photosensitive member 12 in the fully charged state (non image area) may have an equivalent surface potential in the range of −600V. In the discharged area (image area), the photoconductor may have a surface potential of the order of −100V. For a negative toner development system, toner charge density may be of the order of −15 to −20 micro-coloumbs per gram. In order to develop toner to the image areas, the developing roller 23 may be raised to an average voltage of the order of −400V. Typically, the charging unit 14 potentials are of the order of −1000 to −1500V with respect to the photosensitive member 12 ground in order to raise the photosensitive member 12 to the required surface potential.

As illustrated in FIGS. 1 and 2, the cleaning unit 13 is configured to remove and/or clean toner remaining on the photosensitive member 12. In the present embodiment, the cleaning unit 13 includes a cleaner housing 29 having a portion thereof forming a waste tray 28 configured to store toner and a cleaning blade 26 configured to remove toner from the photosensitive member 12 and provide the removed toner, for example, to the waste tray 28. The cleaning blade 26 may be attached directly to the cleaner housing 29 or indirectly through a cleaner support member 26*a*. In one example, the toner removed by the cleaning blade 26 includes toner left on the photosensitive member 12 after the toner image was transferred from the photosensitive member 12 to a substrate 25. In another example, the toner removed by the cleaning blade 26 includes the toner 22 applied to the photosensitive member 12 to lubricate the cleaning blade and/or the photosensitive member 12 prior to activation of the charging unit 14 and formation of the latent image on the photosensitive member 12.

In one embodiment, the memory 11 of the control unit 10 may include initialization instructions and/or code to initialize the image forming apparatus 100. For example, the initialization instructions may reside in firmware therein. In other embodiments, the memory 11 of the control unit 10 may include imaging instructions and/or code to control the image forming apparatus 100 to operate and/or form an image. For example, the imaging instructions may reside in firmware therein. In the present embodiment, the initialization instructions and/or imaging instructions may activate the photosensitive member 12, the charging unit 14, the optical scanning unit 16, the developing unit 15, the biasing unit 19, the transferring unit 17, the fusing unit 18, and the cleaning unit 13.

In the present embodiment, the control unit 10, for example, may initially activate the photosensitive member 12, the developing unit 15, the biasing unit 19 and the cleaning unit 13. Afterwards, the control unit 10 may activate, for example, the charging unit 14, the optical scanning unit 16, the transferring unit 17, and the fusing unit 18. Thus, the toner 22 is applied to the photosensitive member 12 to act as a lubricant, for example, for the cleaning blade 26 and/or the photosensitive member 12 to prevent the cleaning blade 25 from malfunctioning and damage, and to cover the photosensitive member 12 to prevent premature degradation thereof through oxidation which can also increase friction thereon causing cleaning blade malfunction and damage. For example, the photosensitive member 12 may contain one or more materials susceptible to oxidation such as PDMS (or other silicone based lubrication materials) through the manufacturing process or applied after manufacturing. Subsequently, the cleaning blade 26 removes the toner 22 from the photosensitive member 12 to the waste tray 28. In the present embodiment, the toner is applied along a width $w_2$ (FIG. 3) of the photosensitive member in its entirety.

In the one embodiment, the initialization instructions are executed upon the image forming apparatus 100 being turned ON. In another embodiment, the imaging instructions are executed upon the image forming apparatus 100 being turned ON and/or installation of a print cartridge. The print cartridge may have information associated with it, for example, in the form of an electronic tag (etag). The etag may typically be a non volatile silicon based memory element with the appropriate power and data communication interface to enable the reading and writing of data.

In the present embodiment, the charging unit 14 is activated after a predetermined number of rotations are completed by the photosensitive member 12. In one example, the number of completed rotations of the photosensitive member 12 may be determined based on a passage of an amount of time.

The control unit 10 may be implemented in hardware, software, or in a combination of hardware and software. In other embodiments, the control unit 10 may be implemented in whole or in part as a computer program stored in the image forming apparatus 100 locally or remotely in a printer server or a host computing device to be considered part of the image forming apparatus 100.

As illustrated in FIGS. 1 and 2, the transferring unit 17 is configured to transfer the image from the photosensitive member 11 to the substrate 25 and the fusing unit 18 is configured to fix the image to the substrate 25 previously transferred by the transferring unit 17. In one embodiment, the transferring unit 17 is a transfer roller, or the like, which rotates and transfers the image to the paper as it is transported between the photosensitive member 12 and the transfer roller. Also, the fusing unit 18 can be, for example, a pair of fusing rollers that apply heat and/or pressure onto the image on the substrate 25 as the substrate 25 is transported therebetween.

Figure 3:
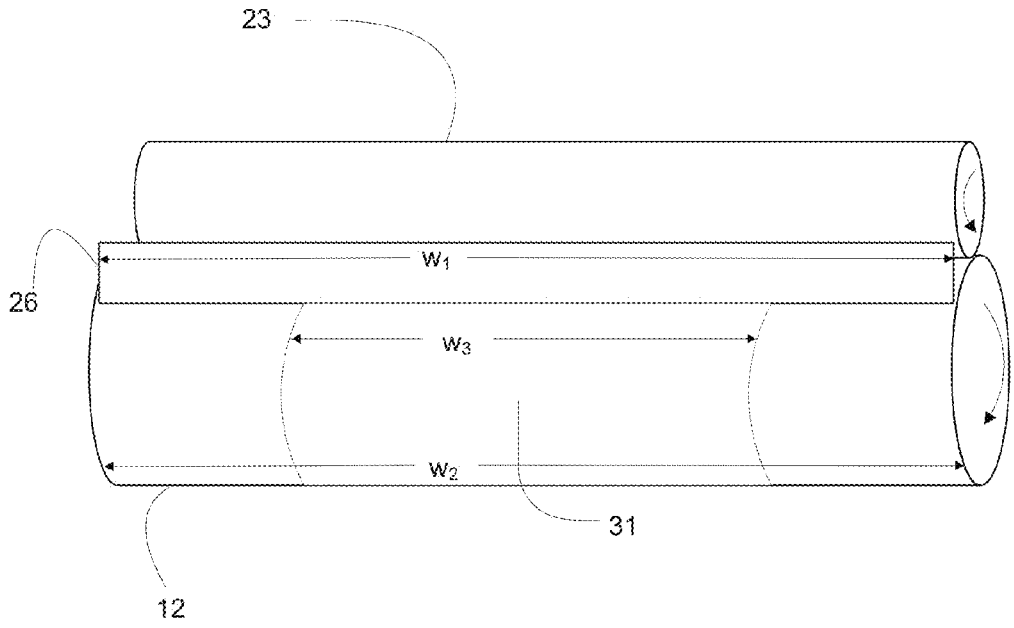
FIG. 3 is a perspective view of a photosensitive member, a developer roller and a cleaning blade of an image forming apparatus according to an embodiment of the present general inventive concept.

FIG. 3 is a perspective view of a photosensitive member, a developer roller and a cleaning blade of an image forming apparatus according to an embodiment of the present general inventive concept. Referring to FIG. 3, the cleaning blade 26 and the developer roller 23 are disposed adjacent to the photosensitive member 12. The developer roller 23 applies the toner 22 to the photosensitive member 12 and the cleaning blade 26 removes toner remaining on the photosensitive member 12. The photosensitive member 12 has a printable area 31. The printable area 31 is an area in which the optical scanning unit 16 can scan to form a latent image thereon corresponding to image data. Each of the cleaning blade 26, the photosensitive member 12, and the printable area 31 have a width, $w_1$, $w_2$, and $w_3$, respectively. In the present embodiment, the width $w_3$ of the printable area is less than the width $w_2$ of the photosensitive member 12, and the width $w_1$ of the cleaning blade exceeds the width $w_3$ of the printable area of the photosensitive member 12. The arrows inside each roller indicate the exemplary rotational direction of the respective rollers in FIGS. 2 and 3. It is envisioned that the rollers may rotate in other suitable directions.

In one embodiment, as illustrated in FIG. 2, a removable print cartridge 27 configured to removably attach to the image forming apparatus 100 (FIG. 1) may include the photosensitive member 12, the charging unit 14, the developing unit 15, and the cleaning unit 13 previously described with reference to FIGS. 1 and 2. In other embodiments, the removable print cartridge 27 may include more or less components than previously described above.

Figure 4:
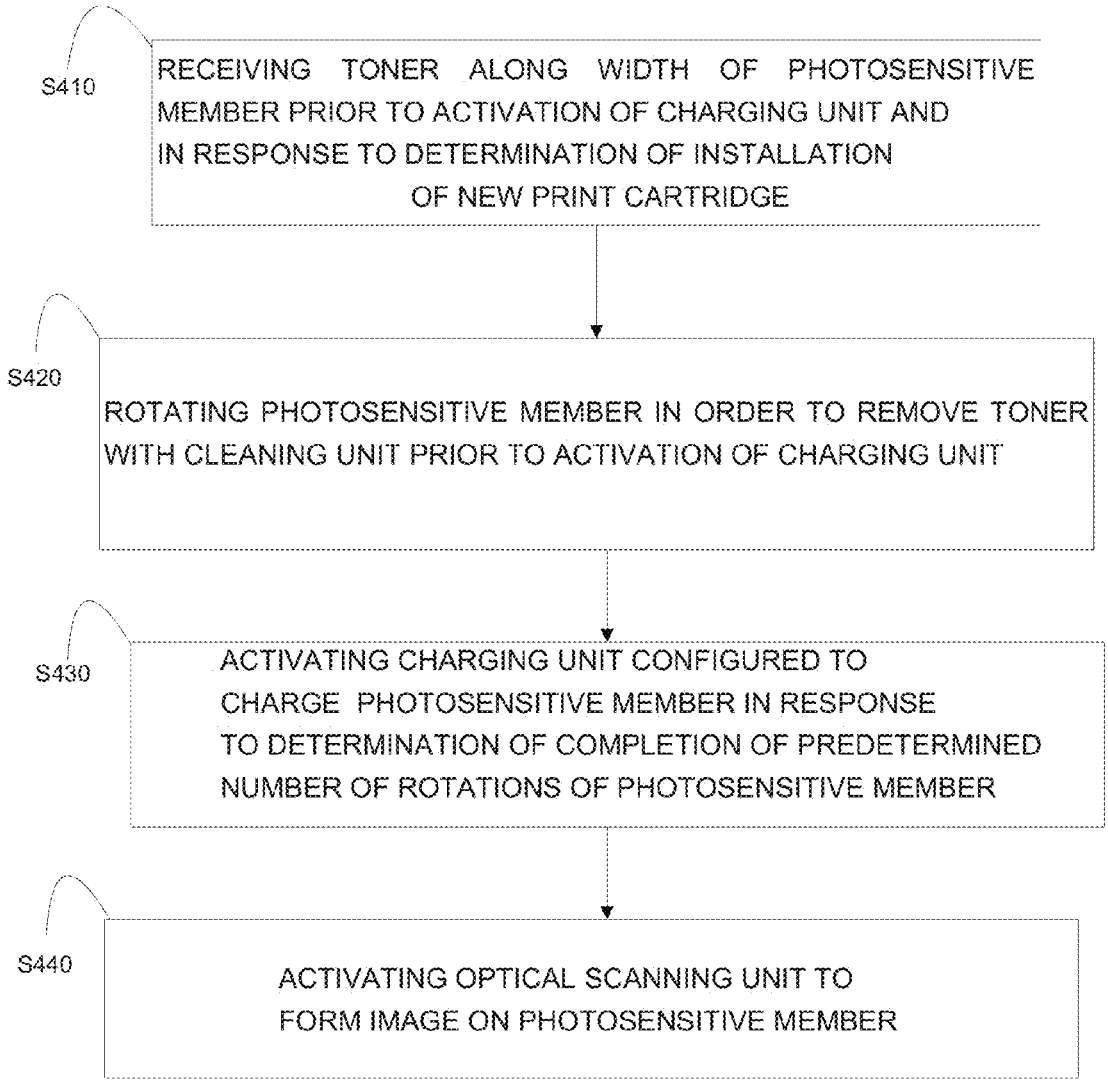
FIG. 4 is a flowchart of an imaging method according to an embodiment of the present general inventive concept.

FIG. 4 is a flowchart illustrating an imaging method according to an embodiment of the present general inventive concept. Referring to FIGS. 1 and 4, in operation S410, a photosensitive member receives toner along a width thereof prior to activation of a charging unit and in response to a determination of installation of a new print cartridge. In operation S420, the photosensitive member is rotated in order to remove the toner with a cleaning unit prior to the activation of the charging unit. In operation S430, the charging unit configured to charge the photosensitive member in response to a determination of a completion of a predetermined number of rotations of the photosensitive member is activated. In operation S440, an optical scanning unit to form an image on the photosensitive member is activated.

In one embodiment, the imaging method may also include activating the transferring unit configured to transfer the image from the photosensitive member to a substrate. Also, receiving toner along a width of the photosensitive member may include activating the photosensitive member configured to rotate, activating a developing unit configured to develop the toner on the photosensitive member, activating a biasing unit configured to establish an electrostatic potential difference to allow the toner to be applied to the photosensitive member from the developing unit, and activating a cleaning unit configured to remove the toner from the photosensitive member. In the present embodiment, the toner is applied by a developing unit along the width of the photosensitive member in its entirety, the photosensitive member is an organic photoconductive drum, and the cleaning unit includes a cleaning blade.

In one embodiment, the cleaning blade has a width greater than a width of a printable area of the photosensitive member, the determination of the completion of the predetermined number of the rotations of the photosensitive member corresponds to a passage of a predetermined amount of time, and at least one of the photosensitive member and the cleaning unit includes PDMS thereon. In the present embodiment, the photosensitive member includes PDMS thereon.

Figure 5:
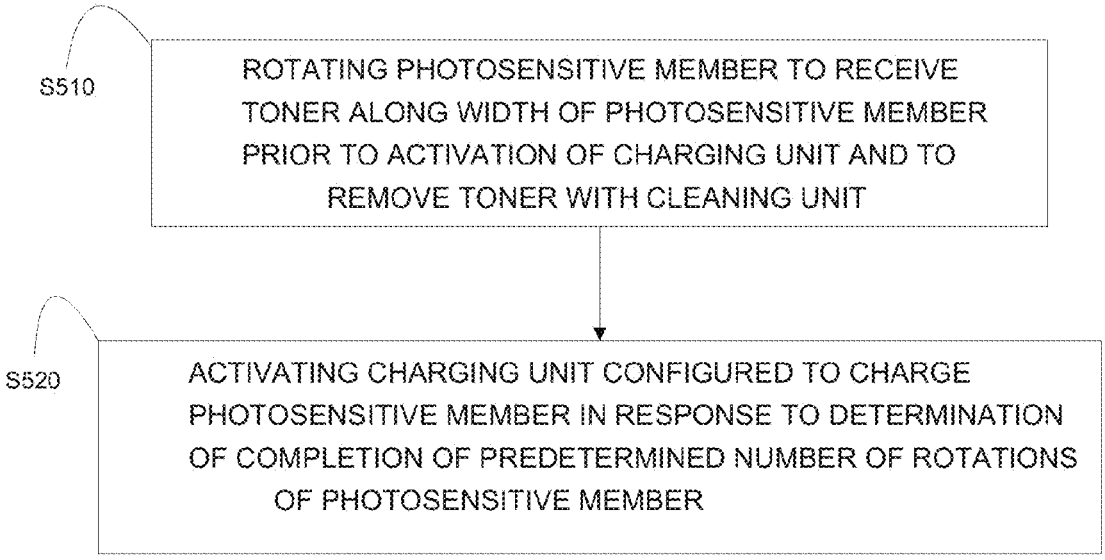
FIG. 5 is a flowchart illustrating an initialization method of an image forming apparatus according to an embodiment of the present general inventive concept.

FIG. 5 is a flowchart illustrating an initialization method of an image forming apparatus according to an embodiment of the present general inventive concept. Referring to FIGS. 1 and 5, in operation S510, a photosensitive member is rotated to receive toner along a width of the photosensitive member prior to activation of a charging unit and to remove the toner with a cleaning unit. In operation S520, the charging unit configured to charge the photosensitive member in response to a determination of a completion of a predetermined number of rotations of the photosensitive member is activated. In one embodiment, rotating a photosensitive member to receive the toner along a width of the photosensitive member includes activating the photosensitive member configured to rotate, activating a developing unit configured to develop the toner on the photosensitive member, activating a biasing unit configured to establish an electrostatic potential difference to allow the toner to be applied to the photosensitive member from the developing unit, and activating a cleaning unit configured to remove the toner from the photosensitive member.

In one embodiment, the initialization method also includes activating a transferring unit configured to transfer the image from the photosensitive member to a substrate and activating an optical scanning unit configured to form an image on the photosensitive member in response to the determination of the completion of the predetermined number of the rotations of the photosensitive member.

It is to be understood that the flowcharts of FIGS. 4 and 5 illustrate an architecture, functionality, and operation of exemplary embodiments of the present general inventive concept. If embodied in software, each block may represent a module, segment, or portion of code that comprises one or more executable instructions to implement the specified logical function(s). If embodied in hardware, each block may represent a circuit or a number of interconnected circuits to implement the specified logical function(s). Although the flowcharts of FIGS. 4 and 5 illustrate a specific order of execution, the order of execution may differ from that which is depicted. For example, the order of execution of two or more blocks may be scrambled relative to the order illustrated. Also, two or more blocks illustrated in succession in FIGS. 4 and 5 may be executed concurrently or with partial concurrence. All such variations are within the scope of the present general inventive concept.

Also, the present general inventive concept can be embodied in any computer-readable medium for use by or in connection with an instruction-execution system, apparatus or device such as a computer/processor based system, processor-containing system or other system that can fetch the instructions from the instruction-execution system, apparatus or device, and execute the instructions contained therein. In the context of this disclosure, a "computer-readable medium" can be any means that can store, communicate, propagate or transport a program for use by or in connection with the instruction-execution system, apparatus or device. The computer-readable medium can comprise any one of many physical media such as, for example, electronic, magnetic, optical, electromagnetic, infrared, or semiconductor media. More specific examples of a suitable computer-readable medium would include, but are not limited to, a portable magnetic computer diskette such as floppy diskettes or hard drives, a random access memory (RAM), a read-only memory (ROM), an erasable programmable read-only memory, or a portable compact disc. It is to be understood that the computer-readable medium could even be paper or another suitable medium upon which the program is printed, as the program can be electronically captured, via, for instance, optical scanning of the paper or other medium, then compiled, interpreted or otherwise processed in a single manner, if necessary, and then stored in a computer memory.

Those skilled in the art will understand that various embodiment of the present invention can be implemented in hardware, software, firmware or combinations thereof. Separate embodiments of the present invention can be implemented using a combination of hardware and software or firmware that is stored in memory and executed by a suitable instruction-execution system. If implemented solely in hardware, as in an alternative embodiment, the present invention can be separately implemented with any or a combination of technologies which are well known in the art (for example, discrete-logic circuits, application-specific integrated circuits (ASICs), programmable-gate arrays (PGAs), field-programmable gate arrays (FPGAs), and/or other later developed technologies. In other embodiments, the present general inventive concept can be implemented in a combination of software and data executed and stored under the control of a computing device.

Once given the above disclosure, many other features, modifications or improvements will become apparent to the skilled artisan. Such features, modifications or improvements are, therefore, considered to be a part of the general inventive concept, the scope of which is to be determined by the following claims.

What is claimed is:

1. An electrophotographic imaging method, comprising:

receiving toner along a width of a photosensitive member prior to activation of a charging unit and in response to a determination of installation of a new print cartridge;

rotating the photosensitive member in order to remove the toner with a cleaning unit prior to the activation of the charging unit;

activating the charging unit configured to charge the photosensitive member in response to a determination of a completion of a predetermined number of rotations of the photosensitive member; and activating an optical scanning unit to form an image on the photosensitive member.

2. The method according to claim 1, further comprising:

activating the transferring unit configured to transfer the image from the photosensitive member to a substrate.

3. The method according to claim 1, wherein developing toner along a width of the photosensitive member comprises:

activating the photosensitive member configured to rotate;

activating a developing unit configured to develop the toner on the photosensitive member;

activating a biasing unit configured to establish an electrostatic potential difference to allow the toner to be applied to the photosensitive member from the developing unit; and activating a cleaning unit configured to remove the toner from the photosensitive member.

4. The method according to claim 1, wherein the toner is applied by a developing unit along a width of the photosensitive member in its entirety.

5. The method according to claim 1, wherein the photosensitive member comprises:

an organic photoconductive drum.

6. The method according to claim 1, wherein the cleaning unit comprises:

a cleaning blade.

7. The method according to claim 6, wherein the cleaning blade has a width greater than a width of a printable area of the photosensitive member.

8. The method according to claim 1, wherein the determination of the completion of the predetermined number of the rotations of the photosensitive member corresponds to a passage of a predetermined amount of time.

9. The method according to claim 1, wherein at least one of the photosensitive member and the cleaning unit includes poly dimethyl siloxane (PDMS) thereon.

10. The method according to claim 9, wherein the photosensitive member includes PDMS thereon.

11. The method according to claim 1, wherein at least one of the photosensitive member and the cleaning unit includes poly dimethyl siloxane (PDMS) thereon.

12. An initialization method of an electrophotographic image forming apparatus, the method comprising:

rotating a photosensitive member to receive toner along a width of the photosensitive member prior to activation of a charging unit and to remove the toner with a cleaning unit; and activating the charging unit configured to charge the photosensitive member in response to a determination of a completion of a predetermined number of rotations of the photosensitive member.

13. The method according to claim 12, wherein rotating a photosensitive member to receive the toner along a width of the photosensitive member comprises:

activating the photosensitive member configured to rotate;

activating a developing unit configured to develop the toner on the photosensitive member;

activating a biasing unit configured to establish an electrostatic potential difference to allow the toner to be applied to the photosensitive member from the developing unit; and activating a cleaning unit configured to remove the toner from the photosensitive member.

14. The method according to claim 13, further comprising:

activating the transferring unit configured to transfer the image from the photosensitive member to a substrate and activating an optical scanning unit configured to form an image on the photosensitive member in response to the determination of the completion of the predetermined number of the rotations of the photosensitive member.

15. A computer-readable medium having embodied thereon a computer program to execute a method, wherein the method comprises:

receiving toner along a width of the organic photoconductive drum (OPC) having poly dimethyl siloxane (PDMS) thereon prior to activation of a charging unit and in response to a determination of installation of a new print cartridge;

rotating the OPC in order to remove the toner with a cleaning blade prior to the activation of the charging unit;

activating the charging unit configured to charge the OPC in response to a determination of a completion of a predetermined number of rotations of the OPC; and activating an optical scanning unit configured to form a latent image on the OPC.

* * * * *